US007302943B2

(12) United States Patent
Rice

(10) Patent No.: US 7,302,943 B2
(45) Date of Patent: Dec. 4, 2007

(54) RAM FOR A PAINTBALL GUN

(75) Inventor: John Ronald Rice, Upper Tean (GB)

(73) Assignee: NPF Limited, Birmingham, Nechells (GB)

( * ) Notice: Subject to any disclaimer, the term of this patent is extended or adjusted under 35 U.S.C. 154(b) by 0 days.

(21) Appl. No.: 11/007,900

(22) Filed: Dec. 9, 2004

(65) Prior Publication Data

US 2005/0126553 A1 Jun. 16, 2005

Related U.S. Application Data

(60) Provisional application No. 60/529,194, filed on Dec. 12, 2003.

(51) Int. Cl.
*F41A 19/00* (2006.01)

(52) U.S. Cl. ..... 124/31; 124/73; 124/75

(58) Field of Classification Search ..... 124/71, 124/74–77

See application file for complete search history.

(56) References Cited

U.S. PATENT DOCUMENTS 4,470,604 A * 9/1984 Hoffmann ..... 273/404
6,003,504 A 12/1999 Rice et al.
6,138,656 A 10/2000 Rice et al.
6,311,682 B1 11/2001 Rice et al.
6,349,711 B1 * 2/2002 Perry et al. ..... 124/73
6,557,542 B1 * 5/2003 Orr ..... 124/70
6,615,814 B1 9/2003 Rice et al.
2003/0079731 A1 * 5/2003 Dobbins ..... 124/76

OTHER PUBLICATIONS

"What an Angel" (article re Angel V6 Gear Special), PGI product catalog, Mar. 1997, pp. 74-75.

* cited by examiner

*Primary Examiner*—Michael J. Carone
*Assistant Examiner*—Gabriel J. Klein
(74) *Attorney, Agent, or Firm*—Foley & Lardner LLP

(57) ABSTRACT

A pneumatic gun firing ram for firing one or more paintballs. The paintball gun includes a body defining a bore, with the bore being in communication with a valve for selectively releasing compressed gas to fire a paintball. A piston is located within the bore, and a rod is mounted within the piston for sliding movement. A hammer is mounted on an end of the rod opposite the piston, the hammer being movable between a first position and a second position relative the piston. A clamp substantially surrounds the rod at a region adjacent the hammer, and a pneumatic valve is adapted to move the pneumatic ram from a first position in the bore at a distance from the poppet valve to a second position in the bore proximate the poppet valve. The clamp is adapted to hold the pneumatic ram in the first position until sufficient pressure has built up to cause the pneumatic ram to overcome the clamp, causing the pneumatic ram to strike the poppet valve, thereby releasing the pressurized gas stream and driving the projectile from the gun.

16 Claims, 8 Drawing Sheets

RAM FOR A PAINTBALL GUN

CROSS-REFERENCE TO RELATED PATENT APPLICATIONS

This application is an application claiming the benefit under 35 USC 119(e) U.S. Application 60/529,194, filed Dec. 12, 2003, incorporated herein by reference in its entirety.

FIELD OF THE INVENTION

The invention relates to a compressed gas powered gun for firing marking pellets or paint balls. More particularly, the present invention relates to rams for loading paint balls into a paint ball gun's proper firing position.

BACKGROUND OF THE INVENTION

A variety of guns using discharged compressed gas for firing relatively fragile projectiles are known for employing manual, semi-automatic, and fully automatic arrangements. Compressed gas powered guns are typically useful as pellet marking guns, commonly called paint ball guns. Paint ball guns have attained widespread use in a recreational sport known as paint ball or war games. Typically located in open spaces with varying types of terrain, opposing sides employ guerilla-type strategy to seek out and "kill" one another by marking the opposition with a paint ball which is fired from a gun and bursts on impact.

Paint ball guns use compressed gas to fire a gelatinous capsule containing a marking material. The marking capsules (paint balls) typically enclose a mixture of water and vegetable coloring so they are not toxic and can be removed from clothing and other surfaces with simple water washing. The capsule breaks on impact with the target dispersing the material to mark the target, for example an opposing player, where hit by the capsule. However, the marking capsule must have sufficient rigidity to avoid breakage during loading and firing operations of the gun.

In U.S. Pat. No. 5,280,778, issued to Kotsiopoulos, a compressed gas powered gun is disclosed having a semi-automatic firing mechanism for enabling successive firing sequences. The firing mechanism includes a sear having a latch arm, with a cam at one end and an interlocking element at the other end. The cam is positioned to close a firing chamber as the latch arm is rotated. The interlocking element is positioned to concomitantly release an actuating bolt as the latch arm is rotated. A recoil spring repositions the actuating bolt for engagement with the interlocking element upon discharge of the firing chamber.

Operation of the trigger of this gun first releases the hammer to fire a paint ball and subsequently switches a valve to re-cock the gun. Thus correct operation requires these two stages to achieve correct operation of the trigger. The timing of these two stages is also dependent upon the speed of trigger operation.

Conventional paint ball guns include a loading ram for loading individual paint balls into a proper firing position inside the paint ball gun. Conventional rams, though having satisfactory performance capabilities, nevertheless include a number of deficiencies. In particular, conventional rams generate a relatively large amount of friction during use. This causes the ram to operate at a relatively slow speed. Additionally, conventional rams are also prone to suffer leakage of compressed gas during use.

SUMMARY OF THE INVENTION

The present invention provides a compressed gas paint ball gun in which the operating cycle is tripped by a trigger operated micro-switch and is subsequently controlled by a programmed electronic control circuit. This avoids the possibility of the cycle not being properly completed or being started again before it has been properly completed.

The present invention provides a paint ball gun which has a first pressurized gas circuit for delivering pressurized propellant gas from a supply to the barrel of the gun. A valve in the first pressurized gas circuit is opened by a pneumatic device which is itself powered from a second pressurized gas circuit feeding from the same supply. A programmed electronic control circuit including a timer operates the pneumatic device. The electronic control device is actuated to begin the firing cycle by means of a switch connected to the trigger of the gun.

The present invention comprises a pneumatic ram having a cylinder mounted within a cylindrical bore of the gun. The pneumatic ram includes a piston mounted on a rod for sliding movement in the cylinder. A hammer is mounted on one end of the rod for sliding movement therewith inside the bore. An o-ring is positioned around the rod at a location adjacent the hammer. When the hammer is in a first or retracted position, the o-ring is located within the cylinder and forms a seal therewith, behaving in a manner similar to a snap ring. When the hammer moves towards a second or extended position, the o-ring moves outside cylinder. This arrangement permits the ram to move from the retracted position to the extended position and vice versa much more rapidly than conventional pneumatic rams for paintball guns, due in part to the low friction between the rod and the cylinder. Additionally, the o-ring does not form a seal until the hammer is fully retracted, and the hammer can remain fully retracted without leaking gas.

BRIEF DESCRIPTION OF THE DRAWINGS

An embodiment of the invention is described below by way of example with reference to the accompanying drawings, in which.

DETAILED DESCRIPTION OF THE PREFERRED EMBODIMENTS

Figure 1:
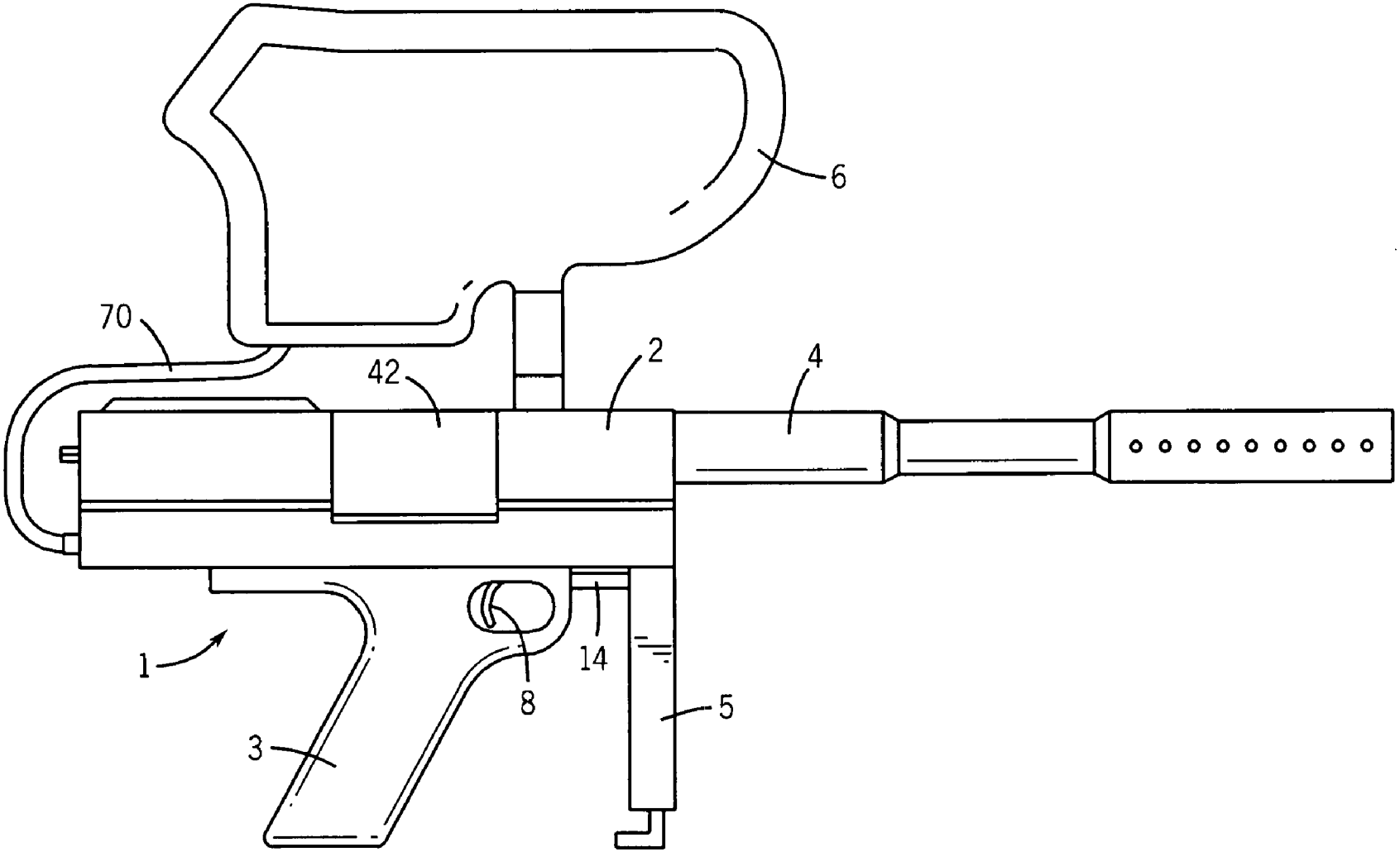
FIG. 1 is a side view of a paint ball gun with a hopper attached.
Figure 2:
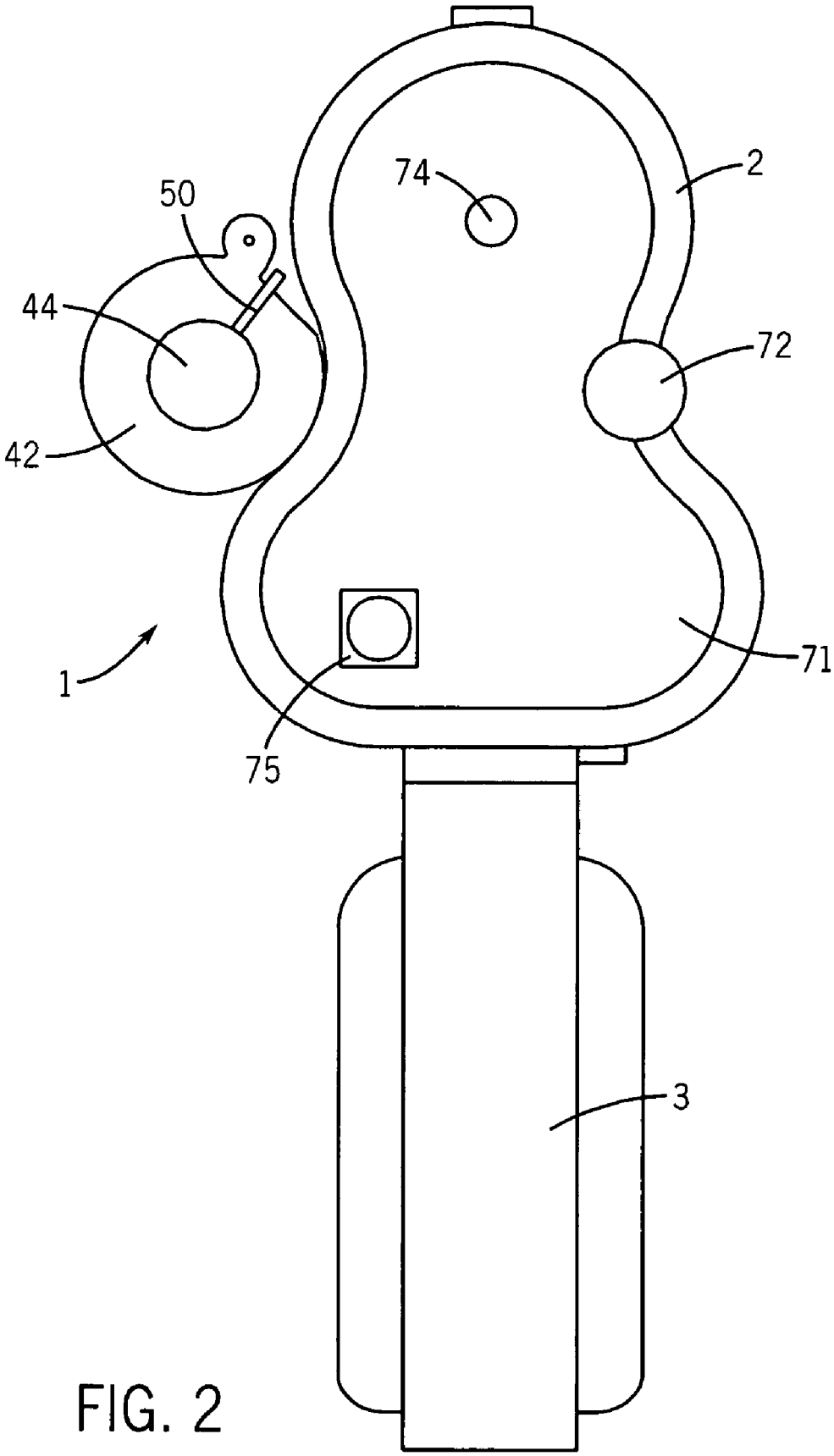
FIG. 2 is a rear view of the paint ball gun of FIG. 1 with the hopper removed and the breech in the open position.

Referring to FIGS. 1-5, a conventional paintball gun 1 includes a main body 2, with a grip frame 3, a barrel 4 and a gas inlet regulator body 5 attached. A paint ball hopper 6 can be mounted on the top of the main body 2.

The grip frame 3 houses an electronic circuit board 7 which carries an electronic programmed control circuit for the gun including a programmed integrated circuit (PIC) 77, a pivotally mounted trigger 8 and a micro-switch 9 for the control circuit which is actuated by the trigger 8. The electronic control circuit is part of an electric circuit for the gun 1 which is powered from a battery 10 (shown in FIG. 5) housed in the main body 2 through an isolator switch 11. The electronic control circuit has a fixed cycle of operation which is governed by a timer.

The gun 1, which uses a gas propellant and a source of pressurized gas such as compressed air at about 800-850 psi, must be connected to the inlet 12 of the regulator body 5 either directly or through a supply line. The body 5 houses a gas pressure regulator which controls the gas pressure within the body chamber 13 to about 400-600 psi. The body chamber 13 is connected by a pipe 14 and a passageway 15 to a high pressure chamber 16 in the gun body. The high pressure chamber 16 is formed in a generally cylindrical bore 17 running the length of the main body 2 and is closed at one end by a bang valve or poppet valve 18 and at the other end by a second gas pressure regulator 19. When the poppet valve 18 is opened it connects the high pressure chamber 16 with the barrel of the gun 4 as described below to form a first pressurized gas circuit for delivering pressurized propellant gas from the supply to the barrel 4 of the gun 1 for propelling paint balls therefrom. The second regulator 19 is a low pressure regulator which bleeds off "low pressure" gas at about 80-90 psi from the high pressure chamber 16 for use in a second pressurized gas circuit which forms the pneumatic control circuit of the gun 1 to be described below.

Figure 3:
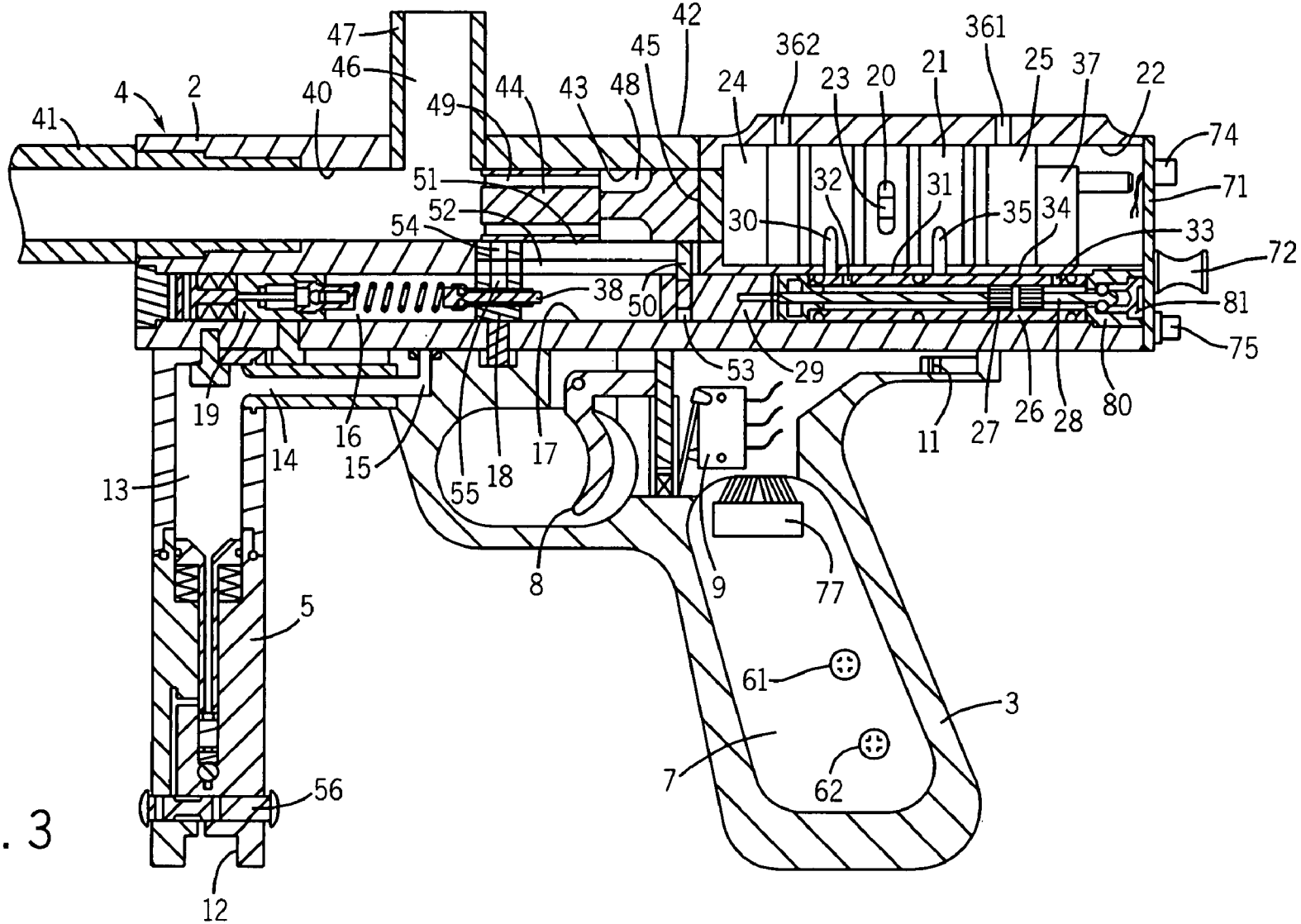
FIG. 3 is a sectional view of a conventional paint ball gun in a first condition.

The low pressure gas is conducted from the left hand end of the regulator 19 (as seen in FIG. 3) through a drilled bore in the body 2 and fed to the inlet 20 of a control valve in the form of a spool valve 21 mounted in a second cylindrical bore 22 in the housing 2. The spool valve 21 has a spindle 23 and a pair of servos 24, 25 mounted at either end of the valve 21 to act on the spindle 23. A boring in the spool valve 21 delivers the low pressure gas to both of the servos 24, 25, but because the servo 25 is more powerful than the servo 24, it normally urges the spindle 23 to the left in FIG. 3.

FIGS. 3-6 show in detail a conventional pneumatic ram 99 having a cylinder 26 mounted in the cylindrical bore 17 generally beneath the spool valve 21. The pneumatic ram 100 has a piston 27 mounted on a rod 28 for sliding movement in the cylinder 26 and a hammer 29 mounted on an end of the rod 28 opposite the piston 27 for sliding movement within the cylinder 26 in the cylindrical bore 17.

Figure 4:
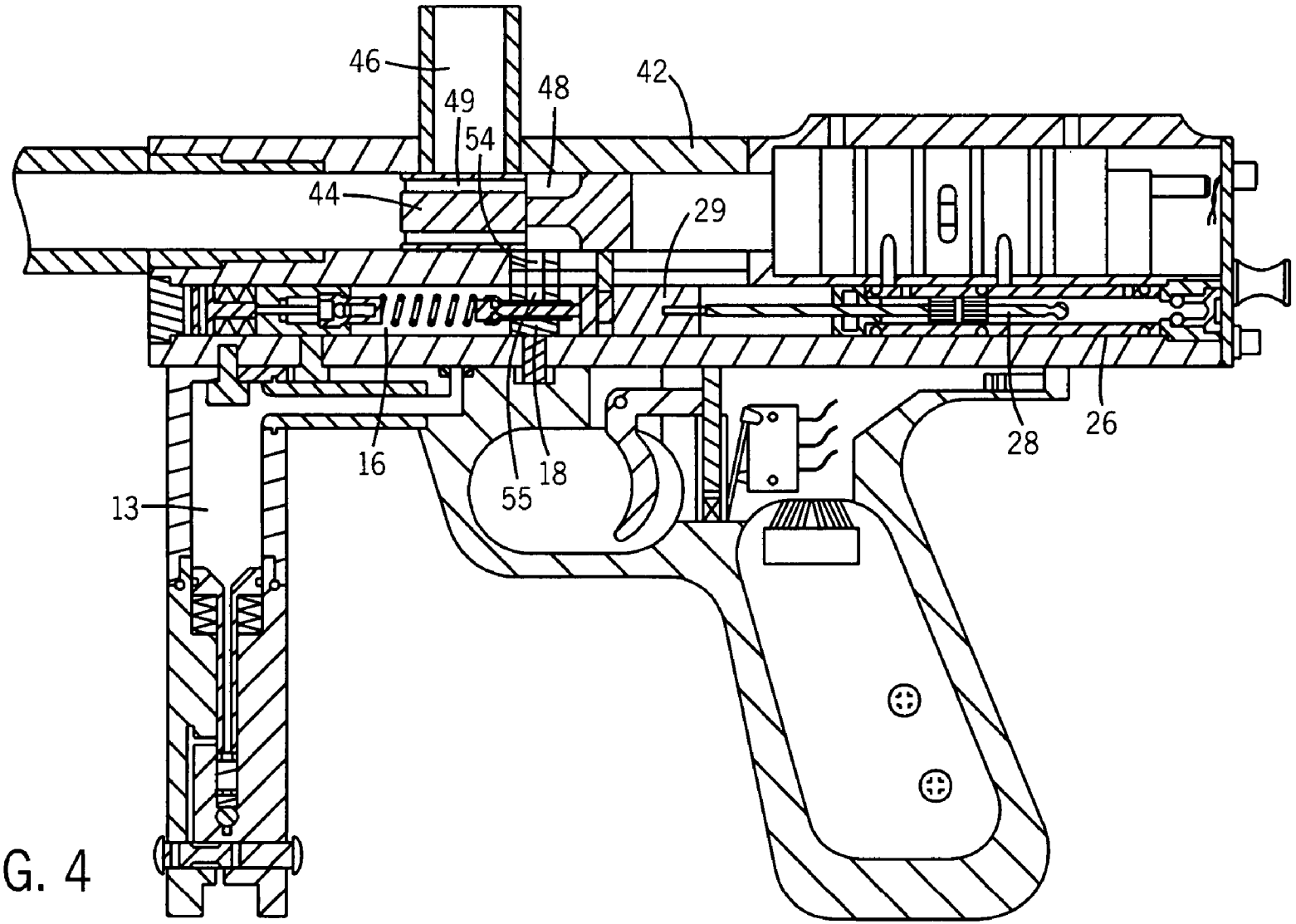
FIG. 4 is a sectional view of the paint ball gun of FIG. 3 when in a second condition.
Figure 5:
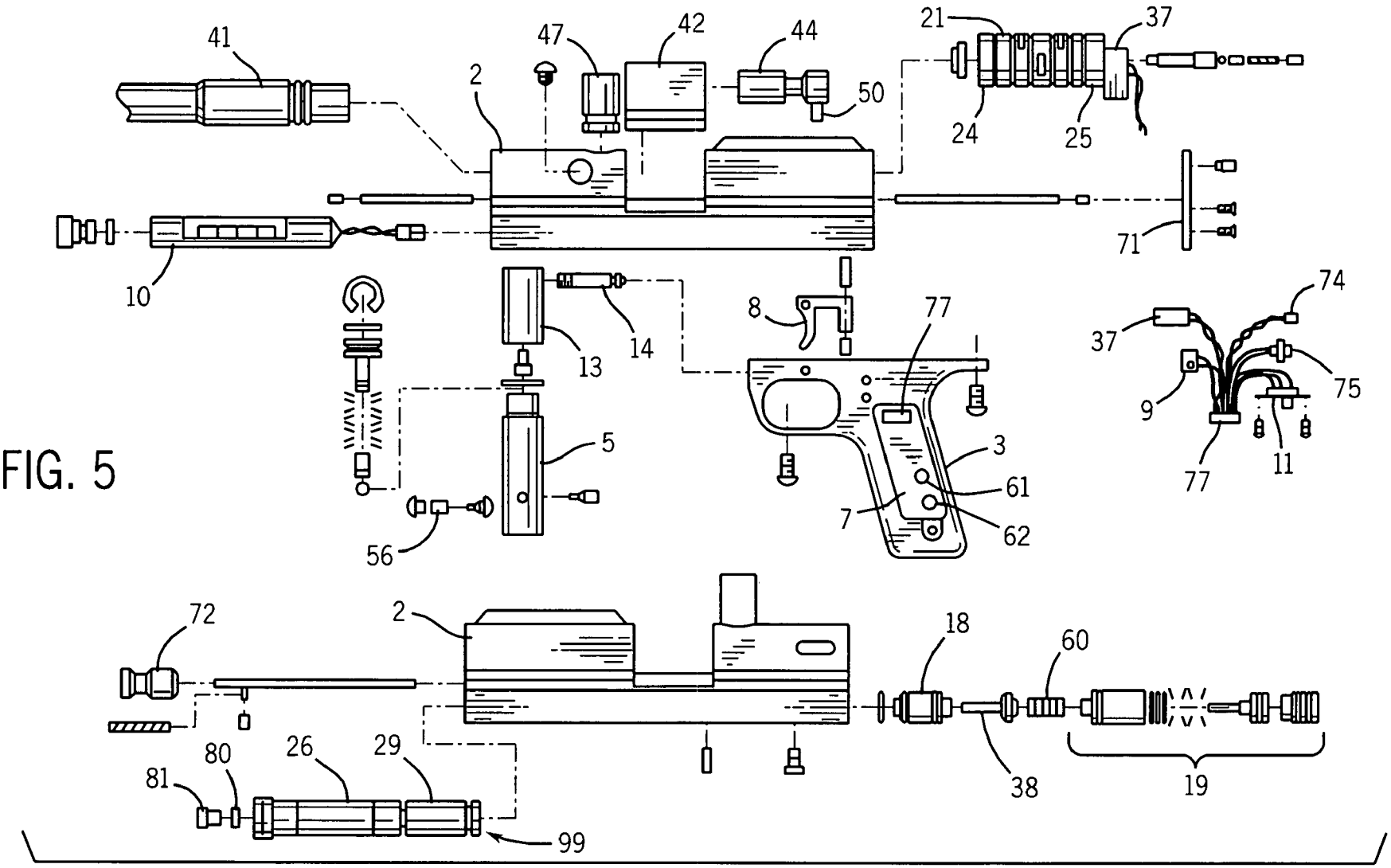
FIG. 5 is an exploded side view of the components of the paintball gun of FIG. 3, including a prior art pneumatic ram.
Figure 6:
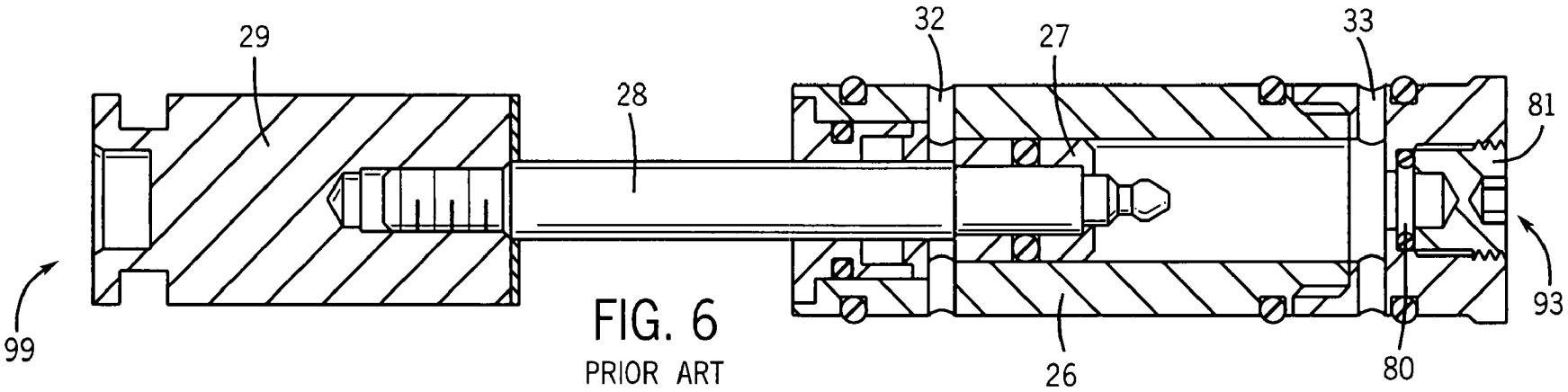
FIG. 6 PRIOR ART
FIG. 6 is a sectional side view of a conventional, prior art ram in an extended position.
Figure 7:
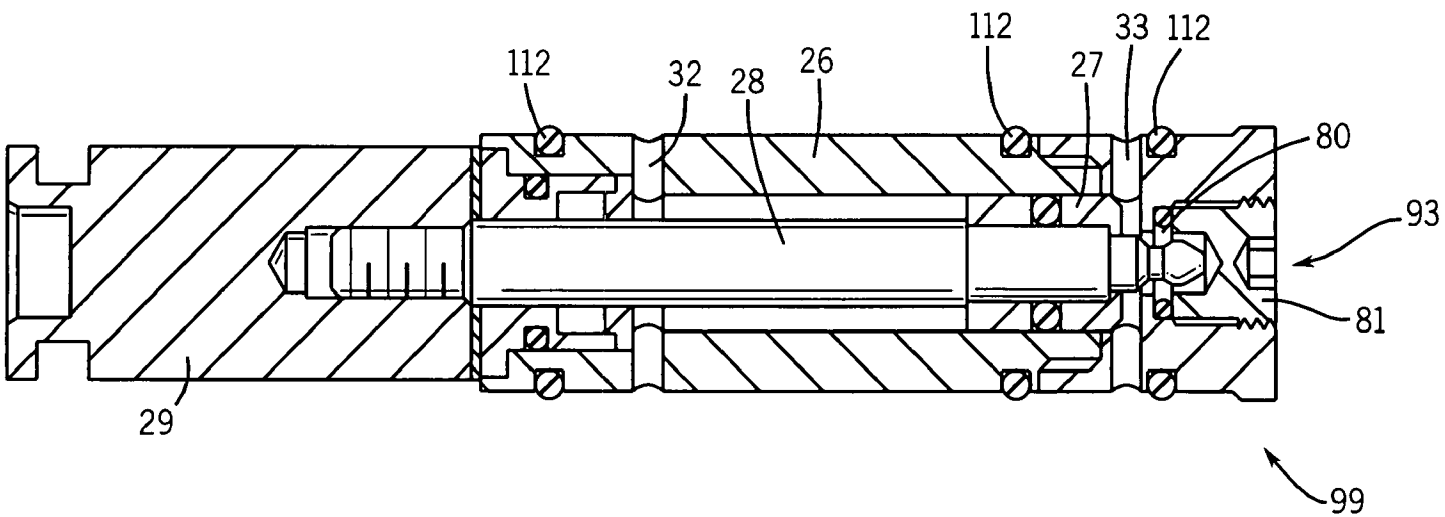
FIG. 7 PRIOR ART
FIG. 7 is a sectional side view of the prior art ram of FIG. 6, with the ram in a retracted position.

FIG. 5 shows an exploded view of the paintball gun of FIG. 4, with the gun 1 including the conventional, prior art pneumatic ram 99. FIGS. 6-7 show the conventional, prior art pneumatic ram 99 in detail. One end of the rod 28 includes a notch 91 by means of which the rod 28 is releasably held in an adjustable clamp 93 comprising an o-ring 80 and an adjusting screw 81.

Figure 8:
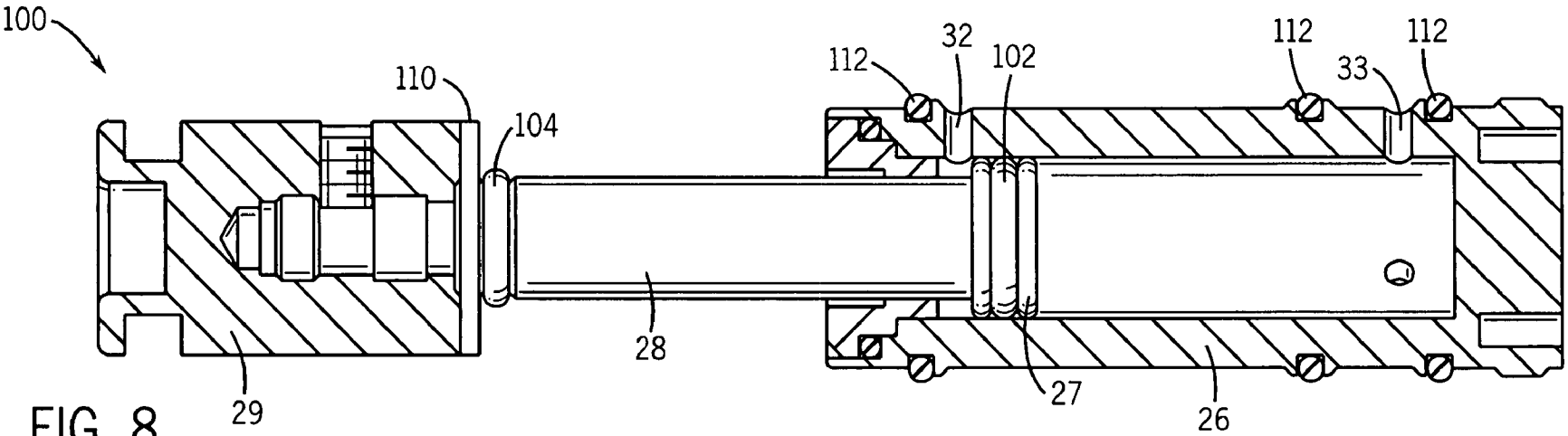
FIG. 8 is a sectional side view of a ram according to the present invention, wherein the ram is in an extended position.
Figure 9:
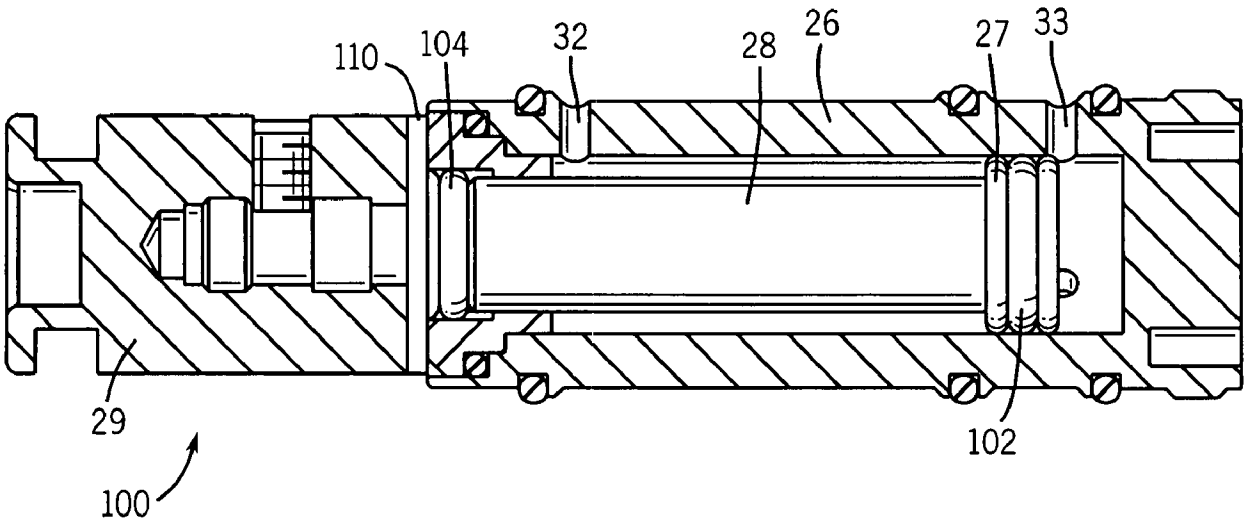
FIG. 9 is a sectional side view of the ram of FIG. 8, with the ram in a retracted position.
Figure 10:
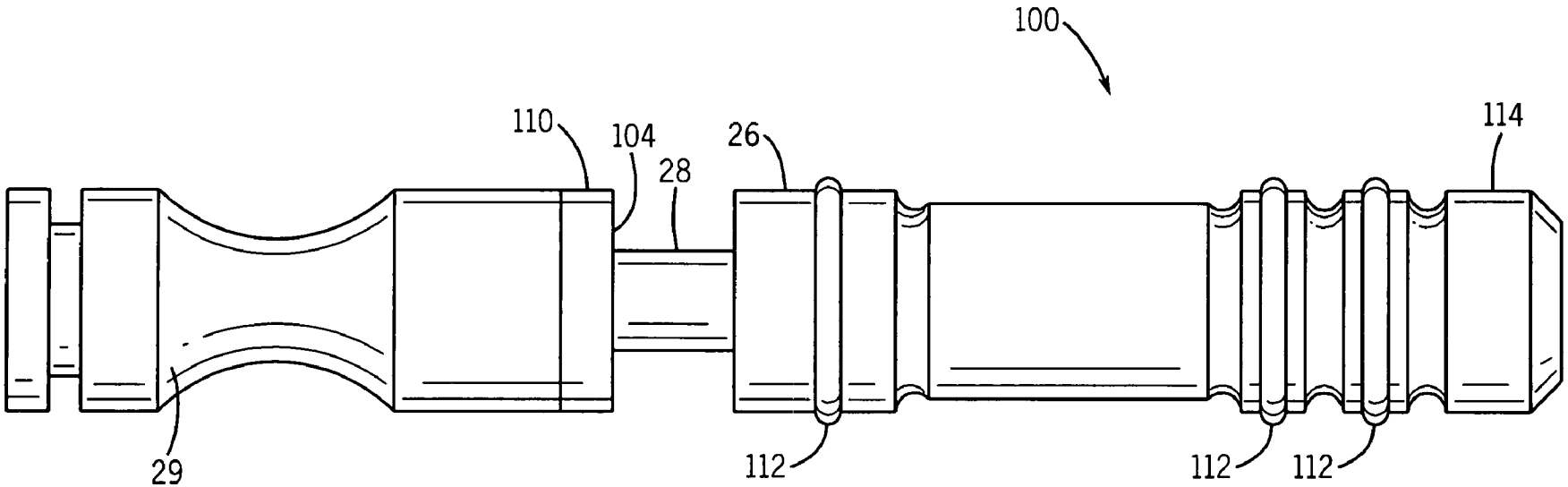
FIG. 10 is a side view of a ram according to another embodiment of the present invention.

FIGS. 8-9 show a pneumatic ram, shown generally at 100, constructed according to the present invention. Like the conventional, prior art pneumatic ram 99, the pneumatic ram 100 of the present invention includes a piston 27 mounted on a rod 28 for sliding movement in the cylinder 26. The hammer 29 is mounted on one end of the rod 28 opposite the piston 27 for sliding movement inside the cylinder 26. The hammer 29 can have a nonuniform diameter, as shown in FIG. 10, so as to reduce the weight of the hammer 29. A bumper 110 may also be included on the rod 28 for absorbing some of the impact of the cylinder 26 against the hammer 29. A piston seal 102 is also positioned around the piston 27 for contacting and forming a seal with the cylinder 26. An o-ring 104 is positioned around the rod 28 at a location adjacent the hammer 29. When the hammer 29 is in a retracted position (shown in FIG. 9), the o-ring 104 is located within the cylinder 26 and forms a seal therewith, behaving in a manner similar to a snap ring. Additional o-rings 112 may be placed along the outside of the cylinder 26 to provide additional sealing capabilities. According to one embodiment of the invention, the outside of the cylinder 26 may include a plurality of threads 114 (shown in FIG. 10) to secure the pneumatic ram 100 to the cylindrical bore 17. Other securing mechanisms known to those skilled in the art could also be used.

When the spool valve 21 of FIG. 3 is in the retracted position, low pressure gas supplied to the valve 21 is directed through valve outlet 30, a space 31 and a forward port 32 to the cylinder 26 on the left hand side of piston 27 to urge the ram 100 to the retracted position shown in FIG. 9. In this position, the cylinder 26 to the right of the piston 27 is vented through a rearward port 33, a space 34, the valve outlet 35 and a vent valve 361.

An electrical solenoid switch is mounted on the servo 25 and can be actuated by the electronic control circuit of the gun to vent the servo 25 to atmosphere. In this condition, the servo 24 prevails to move the spindle 23 of the spool valve 21 to the right in FIG. 3. In this position the low pressure gas supply is directed through the valve outlet 35, the space 34 and the rearward port 33 to the cylinder 26 onto the right of the piston 27 in FIG. 3 to move the ram 100 to the left in FIG. 3 towards its forward or extended position shown in FIGS. 4 and 8, where the hammer 29 engages the poppet 38 of the poppet valve 18 to open the poppet valve 18. The left hand end of cylinder 26 is vented at this time through the forward port 32, the space 31, the valve outlet 30 and a further vent valve 362.

As shown in FIG. 3, the barrel 4 of the gun 1 comprises a third cylindrical bore 40 in the main body 2 coaxial with the second cylindrical bore 22 and a barrel extension 41 which is screwed into the third cylindrical bore 40. A breech block 42 is pivotally mounted on the main body 2 between a closed position shown in FIGS. 1, 3 and 4 and an open position shown in FIG. 2. The block 42 has a fourth cylindrical bore 43 which is aligned with the barrel 4 when the breech is closed and forms the rearmost part of the barrel 4. A bolt 44 is mounted in the breech block 42 for sliding movement in the barrel 4 between the retracted position shown in FIG. 3 in which it lies between the closed end 45 of the barrel 4 and a paint ball inlet 46 and a forward position shown in FIG. 4 in which it closes the inlet 46. The inlet 46 is provided by a pipe 47 which is screwed into the main body 2 and extends vertically upwardly to connect to the hopper 6.

The bolt 44 is generally cylindrical and is formed with an annular groove 48 and a plurality of axially extending bores 49 connecting the forward end of the bolt 44 with the groove 48. A pin 50 mounted on the rearward end of the bolt 44 extends through a slot 51 in the breech block 42 and a slot 52 in the main body 2 into the cylindrical bore 17 where it locates in an annular grove 53 in the hammer 29. Thus the bolt 44 is coupled to the ram 100 for movement therewith. Aligned ports 54 and 55 in the breech block 42 and the main body 2 connect the fourth cylindrical bore 43 with the inside of the poppet valve 18.

Operation of the gun 1 is as follows.

With a source of high pressure gas connected to the inlet 12 of the gas inlet regulator body 5 and the on/off pin 56 pushed to the "on" position shown in FIG. 3, a high pressure gas charge exists in body chamber 13 and high pressure chamber 16. Once the electrical switch 11 has been moved to the "on" position, the gun 1 is ready to fire. A paint ball fed down from the hopper 6 will be located in the barrel 4 adjacent the front end of the bolt 44 which will be in the retracted position shown in FIG. 3. When the trigger 8 is pulled, it operates the micro-switch 9 to actuate the electronic control circuit 7 and start the timer for the electronic control cycle. The electronic control circuit actuates the solenoid switch 37 to vent the servo 25. The servo 24 then moves the spindle 23 of the spool valve 21 so that low pressure gas is delivered to the cylinder 26 to the right of the piston 27 and pressure in that part of the cylinder 26 begins to build. For a conventional, prior art ram 99 shown in FIG. 6, one end of the rod 28 is initially held in the adjustable clamp 93. In FIG. 3, when the pressure in the cylinder 26 to the right of the piston 27 reaches a predetermined level, the rod 28 is released from the adjustable clamp 93 and the ram 99 can move to the left. The cylinder 26 space to the left of the piston 27 is now vented to atmosphere via the forward port 32.

In a pneumatic ram 100 according to the present invention, the o-ring 104 is initially positioned within the cylinder 26, forming a seal therewith. At this point, the hammer 29 is in a retracted position. When the hammer 29 moves towards a second or extended position, the o-ring 104 moves outside the cylinder 26. This arrangement permits the ram 100 to move from the retracted position to the extended position, and vice versa, much more rapidly than conventional pneumatic rams for paintball guns, due in part to the low friction between the piston seal 102 and the cylinder 26. This is in contrast to the conventional, prior art pneumatic ram 99, where friction is generated at other locations along the rod 28. Additionally, the o-ring 104 does not form a seal until the hammer 29 is fully retracted, and the hammer 29 can remain fully retracted without leaking gas.

In FIG. 4, the ram 100 slides rapidly to the left until the hammer 29 strikes the foot of the popper 38 of the poppet valve 17 to lift it from its seat and connect the high pressure chamber 16 with the breech block 42 through the valve 18 and aligned ports 54, 55. This is the "firing" position shown in FIG. 4. As the ram 100 moves to its forward position, it carries the bolt 44 along with it. Thus the bolt 44 slides within the barrel 4 as the ram 100 advances, pushing the waiting paint ball past the inlet 46 and closing off the inlet 46. When the hammer 29 opens the poppet valve 18, the annular groove 48 in the bolt is aligned with ports 54, 55 and high pressure gas thus passes into the barrel 4 through the groove 48 and the axially extending bores 49 to propel the paint ball along the barrel 4 and out of its free end.

After the poppet valve 18 has been momentarily opened by being struck by the hammer 29, it closes under the action of gas pressure. A return spring 60, pushes the ram 100 back a small way (about 1 mm) along the cylindrical bore 17 where it is held by the low pressure gas acting in the cylinder 26.

The bolt 44 remains in the forward position until the timer in the electronic control circuit actuates the solenoid switch 37 to close the vent of the servo 25. Servo 25 moves the spool valve spindle 23 to the left in FIG. 3, and gas pressure is directed through the spool valve 21 to the left side of the piston 27 to return the ram 100 to its retracted position shown in FIG. 3. The timer is set to return the ram 100 and the bolt 44 to the retracted position just as the paint ball is leaving the barrel 4. At this point, a slight negative pressure exists in the barrel adjacent its closed end 45, and as the bolt 44 retracts back past the inlet 46, this negative pressure acts to help draw the next succeeding paint ball waiting in the pipe 47 into the barrel 4. Once a further preset minimum time period has elapsed after the operation of the solenoid switch 37 to return the ram 100 and bolt 44 to their retracted positions, the cycle of the electronic control system is completed; and the electronic control circuit can be operated again by means of the trigger 8 to fire the next paint ball. A control knob 61 on the circuit board can be used to adjust the period of the cycle of the control circuit to vary the length of the cycle and thus the maximum number of shots which can be fired per second. This can normally be varied between about 5 and 15 shots per second. The point within the cycle at which the bolt 44 is withdrawn can also be adjusted by means of a second control knob 62.

The electronic timing of the return of the bolt 44 means that a disadvantage found in prior paint ball guns, where residual pressure in the barrel tends to blow the next succeeding paint ball back towards the hopper, is avoided. This has enabled the feed pipe 47 in the present gun 1 to be disposed vertically whereas in prior guns it has been necessary for the feed pipe 47 to enter the barrel 4 from the side.

The hopper 6 is provided with an electrically driven stirring mechanism. A cable 70 from the hopper 6 to a socket 75 on the gun 1 connects the stirring mechanism to the electric circuit of the gun 1 so that its operation can be controlled by the electronic control circuit. Advantageously the stirring mechanism is actuated whenever the gun 1 is first switched on and at any time when the firing rate of the gun 1 exceeds a predetermined rate such as two shots per second.

As described, the gun 1 is set up for semi-automatic operation, but it can readily be converted to select fire or fully automatic operation in which the electronic control circuit continuously repeats the firing cycle whilst the trigger 8 is actuated. In this case the rate of fire will depend solely on the length of the firing cycle.

An LED 74 mounted on an end plate 71 warns the user that the gun 1 is switched on. The end plate 71 covers the bores 17 and 22 and a further cylindrical bore parallel to both bores 17, 22 which houses the battery 10. A knob 72 adjacent the end plate is pulled to release a catch holding the breech block 42 in the closed position. The end plate 71 also supports the socket 75 which, apart from providing a power connection for the hopper stirring mechanism, can also be used as a charging socket for the battery 10. Removal of the end plate 71 gives access to the adjusting screw 81 of the piston rod clamp.

It should be understood that the term "low pressure" is used herein to refer to a working gas pressure which is generally lower than the high gas pressure used to fire the paint balls but is nevertheless a positive pressure higher than atmospheric pressure. The "high" pressure required in chamber 16 decreases if the size of the chamber 16 is increased and although a high pressure is not needed in the pneumatic control circuit, there is nothing to prevent a high pressure being used. Thus whilst it is preferred that the first pressurized gas circuit will be at a higher pressure than the second pressurized gas circuit as described, this is not essential and the two circuits could run at the same pressure.

It should be understood that the above description of the invention and the specific examples and embodiments, while indicating the preferred embodiments of the present invention, are given by demonstration and not limitation. For example, it should be understood that the present invention could be used in conjunction with a many different varieties of paintball guns besides the particular embodiments described herein. The present invention may be used with paintball guns incorporating a wide range of parameters, including various operating pressures, paintball exit velocities, and component arrangements. Many changes and modifications within the scope of the present invention may therefore be made without departing from the spirit of the invention, and the invention includes all such inventions and modifications.

What is claimed is:

1. A firing ram for use in a paintball gun to fire a paintball, comprising:

a cylinder and a piston in a paintball gun;

a rod disposed in the paintball gun and the rod having a first end mounted within the cylinder for sliding movement;

a hammer mounted on a second end of the rod opposite the first end, the hammer movable between a first position and a second position relative to the cylinder; and an o-ring substantially surrounding the rod at a region adjacent to the hammer, wherein when the hammer is in the first position, the o-ring is positioned on the rod within the cylinder and the o-ring of the rod forms a seal to the cylinder to restrain the movement of the hammer until a sufficient pressure is achieved in the cylinder to overcome the seal, and wherein when the hammer is in the second position, the o-ring is positioned on the rod outside and away from the cylinder, the combination of the hammer, the rod and the piston operating to establish gas pressure in the paintball gun to propel a paintball from the paintball gun and the combination to be recycled repeatedly to propel further ones of the paintball.

2. The firing ram of claim 1, wherein the first end of the rod is coupled to a piston, the piston in sliding contact with the cylinder.

3. The firing ram of claim 2, further comprising means for coupling the cylinder to a bore of the paintball gun.

4. The firing ram of claim 3, wherein the coupling means includes a plurality of threads on the outside of the cylinder for mating with corresponding threads within the bore.

5. The firing ram of claim 3, further comprising a plurality of sealing members on the outside of the cylinder.

6. The firing ram of claim 5, wherein the plurality of sealing members comprise secondary o-rings.

7. The firing ram of claim 1, wherein the hammer has a nonuniform diameter.

8. The firing ram of claim 1, wherein an end of the hammer is configured to engage a poppet valve on the paintball gun.

9. The firing ram of claim 1, further comprising a bumper between the o-ring and the hammer.

10. A firing ram for a paintball gun, comprising a cylinder;

a piston positioned within the cylinder;

a rod coupled to the piston for repetitive cyclic sliding movement relative to the cylinder;

a hammer mounted on an end of the rod opposite to the piston, the hammer movable between a retracted position and an extended position relative to the cylinder; and means for fixing the position of the hammer relative to the cylinder when the hammer is in the retracted position, the hammer remaining fixed in a first position until a sufficient pressure is achieved to overcome the fixing means, wherein the fixing means is positioned on the rod adjacent to the hammer and for each of a plurality of repetitive cycles of use of the firing ram the hammer having the first position when the fixing means is disposed within the cylinder and forming a seal to the cylinder and the hammer having a second position when the fixing means is positioned outside the cylinder.

11. The firing ram of claim 10, wherein the fixing means comprises an o-ring.

12. The firing ram of claim 10, wherein the hammer has a nonuniform diameter.

13. The device of claim 10, wherein the fixing means rests within a notch on the rod.

14. A firing ram for a paintball gun, comprising a cylinder disposed in the paintball gun which has a bore therein;

means for coupling the cylinder to the bore of the paintball gun;

a piston positioned within the cylinder;

a rod coupled to the piston for sliding movement relative to the cylinder;

a hammer mounted on an end of the rod opposite to the piston, the hammer movable between a retracted position and an extended position relative to the cylinder; and means for fixing the position of the hammer relative to the cylinder when the hammer is in the retracted position, the hammer remaining fixed in a first position until a sufficient pressure is achieved to overcome the fixing means, wherein the fixing means is positioned on the rod adjacent to the hammer and the hammer having the first position when the fixing means is disposed within the cylinder and forming a seal to the cylinder and the hammer having a second position when the fixing means is positioned outside the cylinder.

15. The firing ram of claim 14, wherein the coupling means includes a plurality of threads on the outside of the cylinder for mating with corresponding threads within the bore.

16. A firing ram for a paintball gun, comprising a cylinder;

a piston positioned within the cylinder;

a rod coupled to the piston for sliding movement relative to the cylinder;

a hammer mounted on an end of the rod opposite to the piston, the hammer movable between a retracted position and an extended position relative to the cylinder;

means for fixing the position of the hammer relative to the cylinder when the hammer is in the retracted position, the hammer remaining fixed in a first position until a sufficient pressure is achieved to overcome the fixing means, wherein the fixing means is positioned on the rod adjacent to the hammer and the hammer having the first position when the fixing means is disposed within the cylinder and forming a seal to the cylinder and the hammer having a second position when the fixing means is positioned outside the cylinder; and the paintball gun further having a poppet valve and the end of firing ram is configured to engage the poppet valve on the paintball gun.

* * * * *